United States Patent [19]

Laverick et al.

[11] 4,053,195

[45] Oct. 11, 1977

[54] THEFTPROOF CONNECTOR ASSEMBLY

[75] Inventors: Eric W. Laverick, South Nashua, N.H.; Allen I. Horowitz, Windsor Locks, Conn.

[73] Assignee: Hi-G Incorporated, Windsor Locks, Conn.

[21] Appl. No.: 621,872

[22] Filed: Oct. 14, 1975

[51] Int. Cl.[2] ..... H01R 13/54

[52] U.S. Cl. ..... 339/37; 339/82; 339/91 P

[58] Field of Search ..... 339/36, 37, 39, 82, 339/91 P; 285/81, 82, 84, 85, 86

[56] References Cited

U.S. PATENT DOCUMENTS

| | | | |
|---|---|---|---|
| 3,169,030 | 2/1965 | Lippincott | 285/86 |
| 3,206,540 | 9/1965 | Cohen | 339/91 P X |
| 3,684,321 | 8/1972 | Hundhawen et al. | 339/91 P X |
| 3,694,793 | 9/1972 | Concelman | 339/91 P |

*Primary Examiner*—Roy Lake
*Assistant Examiner*—E. F. Desmond
*Attorney, Agent, or Firm*—Prutzman, Hayes, Kalb & Chilton

[57] ABSTRACT

A readily installed and removable coaxial cable connector assembly which is rendered theftproof by the provision of an end cap which may be manually thrust into an open end of a housing surrounding a coaxial cable connector coupling to close the open end of the housing and simultaneously render the coupling inaccessible. The end cap is releasably locked by a plurality of spring fingers formed on a leading end of the cap and movable with a snap action into an internal groove in the housing.

16 Claims, 3 Drawing Figures

THEFTPROOF CONNECTOR ASSEMBLY

This invention generally relates to coaxial cable connectors for joining a cable to a use device and particularly concerns a theftproof connector assembly for coaxial cables generally referred to as "drop cables" used in cable TV systems (CATV) and master antenna systems (MATV).

A primary object of this invention is to provide a new and improved low cost and simplified theftproof connector assembly which is quickly and easily installed and effectively prevents unauthorized removal of the coaxial cable from the use device or adaptor unit to which the cable is joined.

Another object of this invention is to provide such an assembly having improved ease of mechanical and electrical theftproof installation particularly designed for rapid, facile removal by authorized personnel.

A further object of this invention is to provide an assembly of the type described which is suited for use in combination with a special tool for installation and removal of the assembly.

Other objects will be in part obvious and in part pointed out more in detail hereinafter.

A better understanding of this invention will be obtained from the following detailed description and the accompanying drawing of an illustrative application of the invention. In the drawing.

Figure 1:
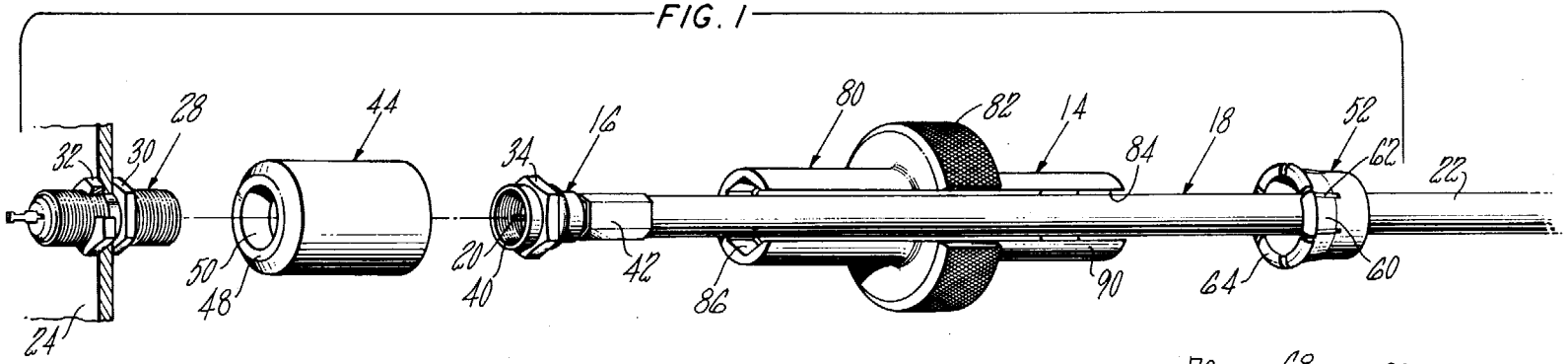
FIG. 1 is an isometric view, partly broken away and partly in section, showing components of the assembly relative to a panel of a use device to which the assembly is joined.

Referring now to the drawing in detail, the theftproof connector assembly 10 of this invention includes a protective housing assembly 12 and complementary installation and removal tool 14 for connecting a coaxial cable connector 16 to a use device, not shown, with which a coaxial cable 18 is to be joined. The coaxial cable 18 comprises a center conductor 20 surrounded by suitable insulation, not shown, covered by a thin conductive foil, not shown, to shield the center conductor 20 from stray RF interference signals. An outer layer 22 of the coaxial cable 18 is preferably formed of any suitable insulating material which protects the cable 18 from moisture and other adverse environmental conditions and which is adapted for electrical and mechanical installation.

Such coaxial cable is commonly found in the installation of cable TV systems or master antenna systems for connection to a special use device or adaptor unit used with a TV set. It is this connection between the adaptor unit and the coaxial cable itself which has been subjected to unauthorized removal and which, upon disassembly, results in loss of the adaptor unit and costly labor expenses in installation of replacement equipment.

The adaptor unit, not shown, will be understood to have a typical bulk head or panel 24 having an opening 26 for receiving an externally threaded, metallic coaxial cable outlet 28. The outlet 28 usually has an integral nut 30 and is positively secured to the panel 24 by locking nut 32 threadably engaged with the outlet 28 on a side of the panel 24 opposite that of the nut 30 such that the outlet 28 itself cannot be removed except by access into the interior of adaptor unit.

To join the coaxial cable 18 to the outlet 28, the metal connector 16 is rotatably joined to a standard coupling comprising a nut 34 trapped by an inter-fitting groove 36 and projection ring 38 serving as a connection to the cable 18. Internal threads 40 within the connector coupling 34 establish the desired mechanical connection to the use device via the coaxial cable outlet 28. The mechanical and electrical connection of the coaxial cable 18 to the connector 16 is accomplished in a wellknown fashion to achieve facile installation and improved holding power of the connector body 16 on the cable 18 provided by the illustrated crimp sleeve 42. Once the coaxial cable 18 has been prepared in a standard manner for installation with its connector 16 terminating the cable 18, the connector 16 may be quickly and easily mechanically installed on the outlet 28.

Various structural arrangements have been utilized in the past to preclude accidental or unauthorized removal of the connector 16 from the outlet 28. However, the known devices have been ineffective in preventing removal of the connector 16 from the outlet by simply rotating the coupling 34 to release it from its threaded engagement with the outlet 28.

In accordance with this invention, the assembly 10 is particularly designed to isolate the coupling 34 so as to render ineffective any unauthorized attempts in releasing coupling 34 from outlet 28 and to retain the connection between the coaxial cable 18 and the adaptor unimpaired, short of severing the cable itself or destroying one or more of the components which would clearly establish intentional theft rather than "accidental" removal.

The assembly 10 features a housing 44 for the coupling 34 which is shown in the preferred embodiment as a generally cylindrical, steel member having an open end 46 for receiving the coupling 34, and a wall 48 at its opposite end. The wall 48 has an opening 50 of sufficient size to be fitted concentrically about the outlet 28 while at the same time being of reduced size relative to the coupling 34. For securing the housing 44 in assembled relation with the coupling 34, a shielding fixture or cap 52 is provided which is adapted to be fitted over the coaxial cable 18, prior to its assembly with the connector 16, and to be manually thrust axially into the open end 46 of the housing 44 so as to protectively enclose its open end 46 and cover the coupling 34 to render it inaccessible from unauthorized tampering.

More specifically, the cap 52 is preferably formed of a tough resilient material such as "Delrin" or other suitable self-lubricating material resistant to temperature changes and impact. The cap 52 has an end wall 54 with a central opening 56 of enlarged size relative to the cable 18 but of reduced size relative to the connector coupling 34. In the preferred embodiment the cap opening 56 is specifically shown as being of reduced size relative to shoulder 58 of the connector body 16. An annular skirt 60 projects axially from the end wall 54 of the cap 52 with a plurality of equally spaced axial slots such as at 62 extending from a free end of the cap 52 toward its end wall 54.

The above described construction serves to provide a plurality of resilient spring fingers intermediate the slots 62 serving as projection means or locking members which are deflectable, due to the resiliency of the material, when the cap 52 is inserted into the open end 56 of the housing 44 so as to be cammed inwardly with a radially enlarged rim 64 of the cap 52 engaging an interior side wall 66 of housing 44. As the cap 52 is inserted into the open end 46 of the housing 44 past its chamfered end wall opening, the rim 64 of the skirt 60 rides down the side wall 66 until the skirt 60 passes a locking shoulder 68 formed by an internal groove 70 circumferentially extending about the interior side wall 66 of the housing.

At this point the resilient spring fingers of the cap 52 spring radially outwardly with a snap lock action to retain the cap 52 in interlocking engagement within the housing 44 by means of an external locking shoulder 72 formed by the radially extending rim 64 of the skirt 60 engaging the internal locking shoulder 68 provided by groove 70 in housing 44.

The parts are relatively configured and dimensioned such that the end wall 54 of the cap 52 in the preferred embodiment is in abutting engagement with the wall 58 of the connector 16 when the spring fingers of the cap 52 are in engaged locking position (FIG. 2) within the internal groove 70 of housing 44. The housing 44 is preferably dimensioned to minimize the spacing between its end wall 48 and the enlarged integral nut 30 on the exposed side of the panel 24 with the components being secured in locked assembly. In the preferred embodiment, the housing 44 extends beyond the coupling 34 so as to overlap the connector body 16 a considerable distance, rendering the coupling 34 virtually inaccessible.

To effect facile installation and ready removal of the theftproof assembly 10 relative to the coaxial cable outlet 28, the cap 52 is fitted over the coaxial cable 18 and the termination of the coaxial cable 18 is then prepared with the installation of the connector body 16 and its crimp sleeve 42; and the housing 44 is then fitted over the coaxial cable outlet 28 whereupon the connector 16 including its coupling 34 and coaxial cable 18 is inserted into the open end 46 of housing 44.

To minimize the number of special tools that a repairman, e.g., will require to make the necessary installation and authorized removal, a complementary tool 80 is provided serving dual functions. The tool 80 provides facile installation of the assembly 10 as well as an important accessory function of disassembling the connection when so authorized. More specifically, the tool 80 comprises a parti-tubular unit having an enlarged knurled diameter portion 82 intermediate its length, serving as a handle, with an uninterrupted slot 84 extending throughout the length of the tool 80. The slot 84 is of a sufficient size to accept the coaxial cable 18 which is to be installed, such that the tool 80 may be concentrically fitted over the cable 18 and moved axially of the cable 18 into engagement with coupling 34. The coupling 34 is mounted, as noted above, for free rotation on the terminal end of the cable 18 and is suited to be threadably secured with the exposed end of the coaxial cable outlet 28 upon being drivingly engaged by an open end socket 86 which is broached to provide a wrench on one end of tool 80.

The tool 80 is dimensioned and configured such that its wrench socket 86 is readily received within the open end 46 of housing 44 and may be rotated by its handle 82 to securely tighten the coupling 34 onto the coaxial cable outlet 28 with the housing end wall 48 interposed between the coupling 34 and panel 24. The tool 80 is then retracted from the housing 44 and withdrawn radially in a direction opposite its slot 84 so as to be completely removed from the cable 18.

The cap 52 is then manually moved axially forwardly on the cable 18 and is inserted with a sliding thrust into the open end of the housing 44. Any suitable instrument such as the tool 80 may be utilized to force cap 52 into assembled relation within housing 44 wherein the spring fingers of cap 52 snap radially outwardly into interlocking engagement with the shoulder 68 of the internal groove 70 in side wall 66 of housing 44.

The above operative steps complete the installation of the theftproof coaxial cable connector assembly 10. Due to the annular configuration of the skirt 60 and the plurality of its spring fingers which engage the internal locking groove 70 within housing 44, it will be seen that cap 52 cannot be accidentally dislodged from its locked engagement within housing 44 and that even intentional removal is rendered virtually impossible. Moreover, the cable 18 itself cannot be manipulated to break the connection to the outlet 28 since the cable 18 is freely rotatable relative to the coupling 34 secured to outlet 28. In the absence of direct access to the internal locking nut 32 on the outlet 28 on the inside face of panel 24, any attempt to remove the connector 16 by rotating the outside nut 30 will meet with failure. In addition the housing 44 and cap 52 are also mounted for rotary movement relative to one another as well as to the coupling 34 and to the connector 16. In short, the disclosed assembly effectively renders it impossible to accidentally remove or otherwise disassemble the components, short of destroying any one of the component parts or severing the cable.

Figure 3:
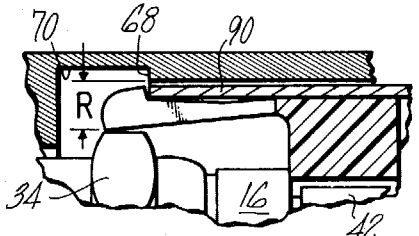
FIG. 3 is a fragmentary view, partly in section, showing certain component parts prior to being disassembled.
Figure 2:
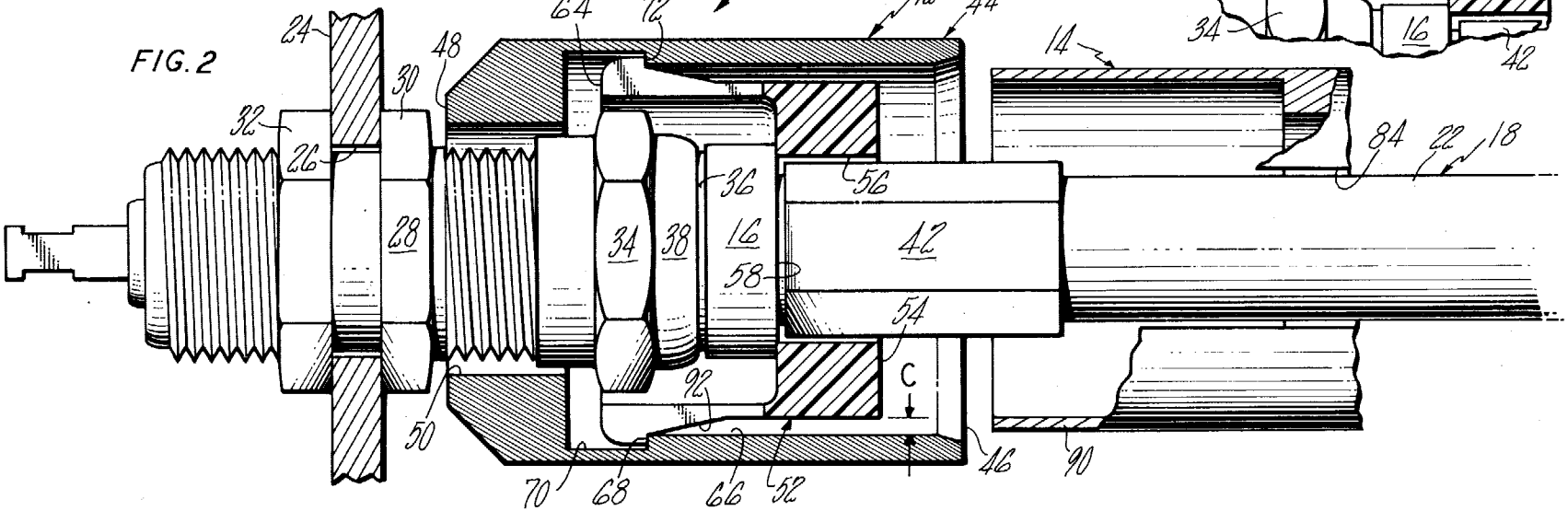
FIG. 2 is a side elevational view, partly broken away and partly in section, showing the components of FIG. 1 assembled on an enlarged scale.

In accordance with another aspect of this invention, the tool 80 is provided with a special thin walled annular shank 90 (FIG. 2) on a side of the handle opposite the wrench socket 86 to effect quick and easy removal of the disclosed coaxial cable connector assembly 10. As best seen in FIG. 2 the assembled components are provided with a clearance "C" between the outside wall of cap 52 and the interior side wall 66 of housing 44. The annular shank 90 of the tool 80 is dimensioned to fit within the clearance "C" such that upon sliding tool shank 90 axially forwardly, it engages a camming surface 92 on cap 52 to move its rim 64 and the spring fingers of skirt 60 radially inwardly from the relaxed engaged position shown in FIG. 2, into a disengaged deflected or loaded position as best seen in FIG. 3. The radially enlarged rim 64 at the free end of the cap 52 is dimensioned such that its thickness is less than the radial clearance "R" between the coupling 34 and the inside diameter of the housing side wall 66 (FIG. 3). The resiliency of the cap material itself serves to effect a retentive force on the open end of the tool shank 90 such that, upon axially withdrawing tool 80, the cap 52 is readily retracted through clearance "R" from the housing 44 through its open end 46 to expose the coupling 34 for ready disassembly, by means of the wrench socket 86, from the TV adaptor unit.

From the foregoing description it will be seen that the disclosed structure is not only a significantly simplified construction but exceedingly rugged and serves the desirable but seemingly imcompatible purposes of ready assembly and facile disassembly in a construction which is virtually tamper-proof and impossible to accidentally dislodge.

As will be apparent to persons skilled in the art, various modifications, adaptations and variations of the foregoing specific disclosure can be made without departing from the teachings of this invention.

We claim:

1. For protecting a coaxial cable connection to a use device, a theftproof assembly comprising a connector including a coupling for connecting a coaxial cable to the use device, a housing for the coupling, the housing having an open end for receiving the coupling, an end cap for enclosing the open end of the housing and protectively shielding the coupling within the housing, the cap having an end wall with an opening of enlarged size relative to the cable but of reduced size relative to the coupling permitting the cap to be fitted over the cable and inserted into the housing by manually sliding the cap over the cable into the open end of the housing, the housing and cap having recess means and complementary projection means movable into interlocking engagement, upon inserting the cap into the housing, for securing the housing and cap in locked assembly with the coupling protectively isolated within the surrounding confines of the assembly.

2. The assembly of claim 1 wherein the cap has a resilient skirt extending from its end wall forming a chamber within the cap for receiving the coupling, wherein the recess means is provided inside the housing, the housing recess means forming an internal locking shoulder intermediate the housing, and wherein the projection means comprises a radially projecting rim formed on the skirt, the skirt being movable from a deflected position, during insertion of the cap, into a relaxed locked position within the recess means with the rim engaging the locking shoulder and securing the housing and cap in locked assembly about the coupling.

3. The assembly of claim 1 wherein the projection means is radially movable from a disengaged position, permitting relative movement of the cap within the housing, into an engaged position with the projection means in interlocking engagement with the recess means.

4. The assembly of claim 1 wherein the housing has a wall with an opening therein formed on its end opposite said open end of the housing, the openings in the housing and the cap both being of enlarged diameter relative to the cable but of reduced diameter relative to the coupling, the end walls of the housing and cap being axially spaced with their openings in concentric alignment with the coupling.

5. The assembly of claim 1 wherein the recess means is formed in the housing and the projection means is formed on the cap.

6. The assembly of claim 1 wherein the connector is fixed to the coaxial cable and coupling is mounted for rotation relative to the connector and the cable.

7. The assembly of claim 1 wherein a predetermined radial clearance is provided between the coupling and its surrounding housing.

8. The assembly of claim 7 wherein the recess means is an internal locking groove formed in the housing, and wherein the projection means is a spring finger on the cap radially movable between a deflected loaded position, permitting sliding of the finger through the radial clearance between the coupling and housing during insertion of the cap, and a relaxed position wherein the spring finger is disposed radially outwardly of its loaded position and received within the locking groove.

9. The assembly of claim 1 wherein the end wall of the cap has an annular configuration with a circumferentially extending, radially deformable resilient skirt terminating in a free end having an external rim comprising said projection means, and wherein the housing has a circumferentially extending internal groove therein comprising said recess means and defining an internal locking shoulder for confronting locking engagement with the rim of the cap upon its being inserted into the housing.

10. The assembly of claim 9 wherein the skirt of the cap is interrupted by an axial slot extending from its free end toward the end wall of the cap.

11. The assembly of claim 10 wherein the slot in the skirt provides resilient spring fingers on opposite sides of the skirt, the fingers being movable between a radially deflected, loaded position, permitting relative movement between the cap and housing, and a radially expanded, relaxed position wherein the rim of the skirt is received within the internal groove of the housing in interlocking engagement with its locking shoulder.

12. The assembly of claim 9 wherein a predetermined radial clearance is provided between the coupling and its surrounding housing, and wherein the radial thickness of the rim of the cap is less than the clearance between the coupling and the housing.

13. The assembly of claim 9 wherein the skirt has an external camming surface tapering from the rim toward the end wall of the cap.

14. A theftproof coaxial cable connector assembly comprising a coaxial cable coupling for connection to a use device, a housing having a passageway therethrough for receiving the coupling, the passageway having a radially enlarged recess forming an internal locking shoulder intermediate the length of the housing, and a shielding fixture having a body engageable with the coupling and a resilient skirt extending from the body and insertable between the coupling and the housing, the skirt having an outwardly radially projecting rim movable into the recess for engagement with its locking shoulder for releasably securing the housing with the coupling enclosed within the housing and cap in locked assembly.

15. The combination of a coaxial cable connector assembly and a tool therefor wherein:

A. the connector assembly comprises:

a. a connector including a coupling for connecting a coaxial cable to a use device, b. a housing for the coupling, the housing having an open end for receiving the coupling, c. an end cap for enclosing the open end of the housing and protectively shielding the coupling within the housing, the cap having an end wall with an opening of enlarged size relative to the cable but of reduced size relative to the coupling permitting the cap to be fitted over the cable and inserted into the housing by manually sliding the cap over the cable into the open end of the housing, d. the housing and cap having recess means and complementary projection means movable into interlocking engagement, upon inserting the cap into the housing, for securing the housing and cap in locked assembly with the coupling protectively isolated within the surrounding confines of the assembly, and B. the tool comprises:

a. an elongated tool body of arcuate cross section, the tool body being dimensioned and configured to be insertable between the cap and the housing to move said projection means relative to said recess means from engaged position into disengaged position for releasing the housing and cap from locked assembly and withdrawing the cap from the housing.

16. The combination of a coaxial cable connector assembly and a tool therefor wherein:

A. the connector assembly comprises:

a. a connector including a coupling for connecting a coaxial cable to a use device, b. a housing for the coupling, the housing having an open end for receiving the coupling, c. an end cap for enclosing the open end of the housing and protectively shielding the coupling within the housing, the cap having an end wall with an opening of enlarged size relative to the cable but of reduced size relative to the coupling permitting the cap to be fitted over the cable and inserted into the housing by manually sliding the cap over the cable into the open end of the housing, d. the end wall of the cap having an annular configuration with a circumferentially extending, radially deformable resilient skirt terminating in a free end having an external rim comprising said projection means, the skirt of the cap being interrupted by an axial slot extending from its free end toward the end wall of the cap and having an external camming surface tapering from the rim toward the end wall of the cap, e. the housing having a circumferentially extending internal groove therein comprising said recess means and defining an internal locking shoulder for confronting locking engagement with the rim of the cap upon its being inserted into the housing, and B. the tool comprises:

a. an elongated tool body of arcuate cross section, the tool body being dimensioned and configured to be insertable between the housing and the cap to engage the camming surface of the cap and to radially compress the same within the body of the tool for removing the cap upon withdrawing the tool axially from the housing.

* * * * *